United States Patent [19]

Ohkubo

[11] Patent Number: 4,557,239

[45] Date of Patent: Dec. 10, 1985

[54] CENTRIFUGAL INJECTION TIMING CONTROL DEVICE FOR FUEL INJECTION PUMPS

[75] Inventor: Hideo Ohkubo, Higashimatsuyama, Japan

[73] Assignee: Diesel Kiki Co., Ltd., Higashimatsuyama, Japan

[21] Appl. No.: 647,978

[22] Filed: Sep. 6, 1984

[30] Foreign Application Priority Data

Sep. 14, 1983 [JP] Japan ..... 58-142556[U]

[51] Int. Cl.[4] ..... F02M 59/20

[52] U.S. Cl. ..... 123/501; 123/502; 464/2

[58] Field of Search ..... 123/501, 502; 464/2, 464/3, 5

[56] References Cited

U.S. PATENT DOCUMENTS 4,332,227 6/1982 Bauer et al. ..... 123/501

FOREIGN PATENT DOCUMENTS

| | | | |
|---|---|---|---|
| 240933 | 8/1962 | Australia | 123/501 |
| 1113609 | 9/1961 | Fed. Rep. of Germany | 123/501 |
| 2842740 | 4/1980 | Fed. Rep. of Germany | 123/501 |
| 563617 | 1/1979 | Japan . | |
| 148033 | 9/1982 | Japan | 123/501 |
| 2066419 | 7/1981 | United Kingdom | 123/501 |

*Primary Examiner*—Magdalen Y. C. Moy

*Attorney, Agent, or Firm*—Frishauf, Holtz, Goodman & Woodward

[57] ABSTRACT

Centrifugal weight members are accommodated within a housing arranged concentrically with a driven rotary member and rotatable in unison therewith, and engage a driving rotary member through double eccentric cam means. The centrifugal weight members define a radially inner chamber in cooperation with the driven rotary member, and radially outer chambers in cooperation with the housing, and are formed with passages communicating the above chambers with each other.

3 Claims, 7 Drawing Figures

CENTRIFUGAL INJECTION TIMING CONTROL DEVICE FOR FUEL INJECTION PUMPS

BACKGROUND OF THE INVENTION

This invention relates to a fuel injection pump for internal combustion engines, and more particularly to a centrifugal injection timing control device for use in in-line type fuel injection pumps.

Conventional centrifugal injection timing control devices for use with in-line type fuel injection pumps for diesel engines include an eccentric type, as disclosed e.g. in Japanese Provisional Patent Publication (Kokai) No. 54-3617, which comprises a driven rotary member adapted to be coupled to a camshaft of the fuel injection pump, a driving rotary member adapted to be coupled to an output shaft of the engine, a housing rigidly fitted on the driven rotary member for rotation in unison therewith, centrifugal weight means accommodated within the housing and displaceable diametrically thereof in response to rotation of the driven rotary member, and double eccentric cam means interposed between the driving rotary member and the centrifugal weight means and engaging with both of them.

According to the above centrifugal injection timing control device, the centrifugal weight means includes a pair of centrifugal weight members arranged diametrically oppositely with respect to the driven rotary member. Each of the centrifugal weight members is disposed to define a radially inner chamber in cooperation with the driven rotary member and a radially outer chamber in cooperation with the housing. The housing has it interior filled with oil for lubricating various parts of the injection timing control device. When the centrifugal weight members are in their non-lifted or retracted position, they abut against each other by means of spring means incorporated therein, to define therebetween an annular enclosed space, i.e. the above radially inner chamber, in cooperation with the driven rotary member, thus preventing the oil in the radially inner chamber from flowing into the radially outer chamber, as well as preventing the oil in the radially outer chamber from flowing into the radially inner chamber. As a consequence, a hysteresis characteristic exists in the action of the centrifugal weight members between the lifting stroke and the retracting or returning stroke, which makes it difficult to achieve a proper injection timing characteristic.

Further, there is a problem that the injection timing device of this type cannot have the same injection timing characteristic when it is in actual use with an engine as that obtained by adjustment in the factory.

SUMMARY OF THE INVENTION

It is the object of the invention to provide a centrifugal injection timing control device for fuel injection pumps, which can eliminate a hysteresis characteristic in the action of the centrifugal weight means between the lifting stroke and the retracting stroke, to thereby achieve a proper injection timing characteristic, and obtain the identical injection timing characteristic between at adjustment and in actual use.

The present invention provides a centrifugal injection timing control device for fuel injection pumps, which comprises a driving rotary member, a driven rotary member, a housing arranged concentrically with the driven rotary member and rotatable in unison therewith, centrifugal weight means accommodated within the housing and displaceable diametrically thereof in response to rotation of the driven rotary member, the centrifugal weight means defining a radially inner chamber in cooperation with the driven rotary member and at least one radially outer chamber in cooperation with the housing, and double eccentric cam means interposed between the driving rotary member and the centrifugal weight means and engaging with both of them. Diametrical displacement of the centrifugal weight means causes corresponding circumferential displacement of the driven rotary member relative to the driving rotary member through the double eccentric cam means. The centrifugal injection timing control device is characterized by comprising passage means formed in the centrifugal weight means and communicating the radially inner chamber with the radially outer chamber.

The above and other objects, features and advantages of the invention will be more apparent from the ensuing detailed description taken in conjunction with the accompanying drawings.

DETAILED DESCRIPTION

Figure 1:
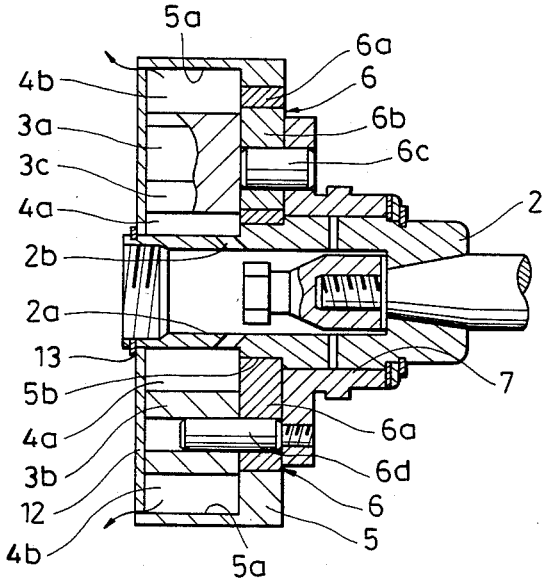
FIG. 1 PRIOR ART
FIG. 1 is a longitudinal sectional view of a centrifugal injection timing control device of the eccentric type.
Figure 2:
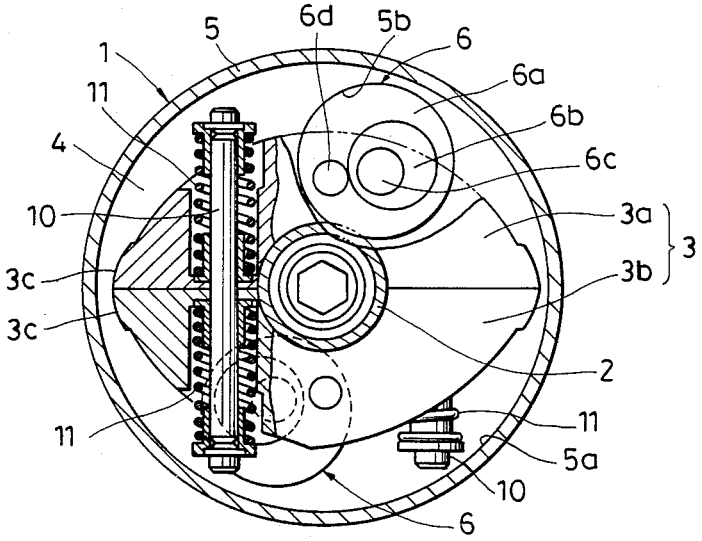
FIG. 2 PRIOR ART
FIG. 2 is a front view, partly in section, of the centrifugal injection timing control device of FIG. 1.
Figure 3:
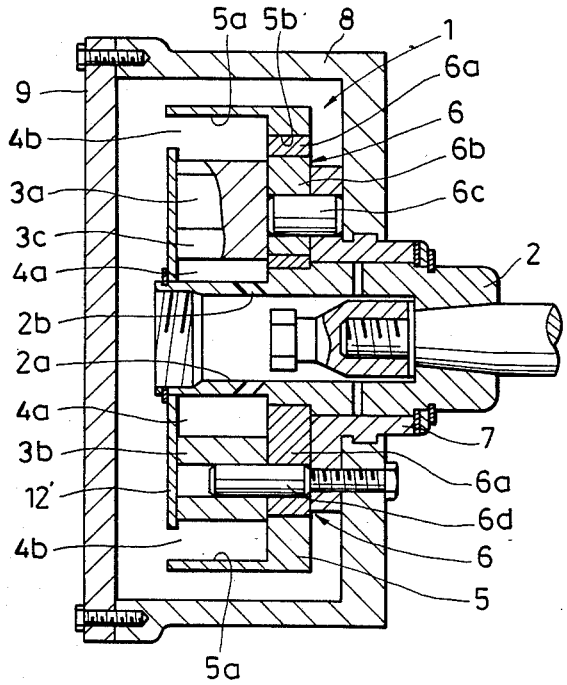
FIG. 3 PRIOR ART
FIG. 3 is a longitudinal sectional view of the centrifugal injection timing control device of FIGS. 1 and 2 which is subjected to adjustment.

FIGS. 1 through 3 illustrate a conventional centrifugal injection timing control device of the eccentric type adapted for use in in-line type fuel injection pumps. The eccentric type injection timing control device 1 comprises a hollow center shaft 2 forming a driven rotary member and adapted to be coupled to a camshaft of the fuel injection pump, a hub 7 forming a driving rotary member and rotatably fitted on the center shaft 2, a flange 5 having a U-shaped section and rigidly fitted on the center shaft 2 for rotation in unison therewith, centrifugal weight means 3 accommodated within the flange 5 and displaceable diametrically thereof in response to rotation of the center shaft 2, and a pair of double eccentric cam mechanisms 6 and 6 arranged diametrically oppositely in the flange 5 and engaging the hub 7 with the centrifugal weight means 3 therethrough.

The double eccentric cam mechanisms 6, 6 each comprise a large-sized eccentric cam *6a* with a larger diameter rotatably fitted in a bore *5b* formed through a radially extending main portion of the flange 5 at a predetermined location, a small-sized eccentric cam *6b* with a smaller diameter rotatably fitted in the eccentric cam 6a in eccentricity therewith, and pins 6c and 6d rotatably fitted at one ends in the eccentric cams 6b and 6a, respectively, in eccentricity therewith. The pin 6d has its other end fitted in the centrifugal weight means 3 accommodated in the flange 5, whereas the pin 6c has its other end engaged in the hub 7 as a driving rotary member, which is rotatably fitted on the center shaft 2. The hub 7 is coupled to an output shaft of an engine, not shown, through a gear, not shown, mounted on the hub 7 at its outer periphery.

The centrifugal weight means 3 includes two semicircular centrifugal weight members 3a and 3b arranged diametrically oppositely with respect to the center shaft 2. The centrifugal weight members 3a, 3b are displaceable by the centrifugal force caused by rotation of the output shaft of the engine, against the elastic force of compression coil springs 11 and 11, in a diametrically outward direction along a path regulated by pins 10 and 10, so that the resulting displacement of the large and small cams 6a, 6b relative to each other causes circumferential displacement of the center shaft 2 relative to the hub 7, to thereby vary the angular position of the center shaft 2 relative to the output shaft for adjustment of the amount of advance of the injection timing control device.

A shim 12, which cooperates with the flange 5 to form a housing for the centrifugal weight members, is rigidly fitted on the center shaft 2 at a predetermined axial location by means of a retaining ring 13 and disposed in contact with the centrifugal weight members 3a, 3b to hold same in a predetermined axial position.

When the centrifugal injection timing control device 1 constructed as above is actually installed between the engine and the fuel injection pump and assumes the illustrated position in FIG. 2, the lubricant oil in the radially inner chamber 4a or in a radially outer chamber 4b is prohibited from flowing into the chamber 4b or the chamber 4a due to the presence of the centrifugal weight members 3a, 3b therebetween.

On the other hand, when the centrifugal injection timing control device 1 is subjected to an injection timing adjustment, as shown in FIG. 3, a rotary housing 8 in lieu of the aforementioned gear is mounted on the hub 7 with an end cover 9 secured thereto, thereby forming a hermetic casing accommodating the whole body of the centrifugal injection timing control device 1. The hermetic casing has its interior filled with oil. In addition, the shim 12 is replaced by a shim 12' having an outer diameter smaller than the inner diameter of the opening of the flange 5, to facilitate introduction of oil into the chamber 4b for adjusting the amount of advance of the injection timing. Thus, the amount of oil present in the chamber 4b is different between when the injection timing control device is in actual use and when it is at adjustment, while the centrifugal weight members are in their retracted position, and accordingly the injection timing advancing characteristic (the advance starting timing) is different between the two cases.

When, in actual use, the centrifugal weight members 3a, 3b are displaced outwardly to their maximum lifted position with their outer peripheral surfaces 3c and 3c disposed in contact with the inner peripheral surface of the flange 5, the oil in the chamber 4b flows out of the chamber 4b. Therefore, negative pressure is developed in the chamber 4b as the centrifugal weight members 3a, 3b return toward the center shaft 2 with a decrease in the centrifugal force produced in the members 3a, 3b, and accordingly the centrifugal weight members 3a, 3b do not promptly retract toward the center shaft 2, resulting in a hysteresis in the action of the centrifugal weight members between the lifting stroke and the retracting stroke.

The invention will now be described in detail with reference to FIGS. 4 through 7 illustrating embodiments thereof.

Figure 4:
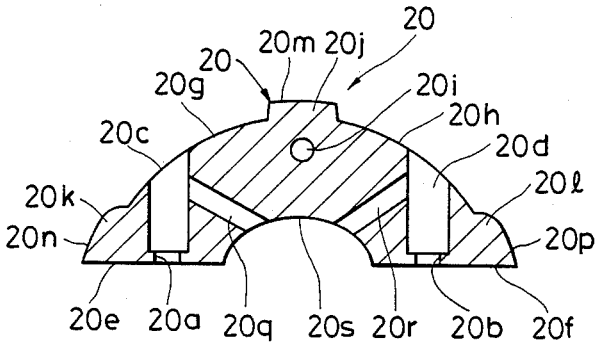
FIG. 4 is a transverse sectional view of a centrifugal weight member for use in an eccentric type centrifugal injection timing control device according to one embodiment of the present invention.

First, FIG. 4 shows a section of a centrifugal weight member, which is used in a centrifugal injection timing control device according to the invention. The centrifugal weight member 20 has a semicircular section and is formed with parallel extending bores 20a and 20b at its opposite sides, through which pins corresponding to the pins 10, 10 in FIG. 2 are slidably inserted, and large-sized spring bores 20c and 20d continuous from and in concentricity with the bore 20a, 20b for accomodating therein the compression coil springs corresponding to the springs 11, 11 shown in FIG. 2. The bores 20a and 20b open at one ends in planar surfaces 20e and 20f, respectively, which are disposed opposite the other one of the paired centrifugal weight members, whereas the bores 20c and 20d open at one ends in outer peripheral surfaces 20g and 20h, respectively, which are disposed opposite the inner peripheral surface 5a of the flange 5 appearing in FIG. 5.

The centrifugal weight member 20 has its substantially central portion formed with an axial hole 20i into which one end portion of a pin corresponding to the pin 6d appearing in FIGS. 1 and 2 is force fitted.

The centrifugal weight member 20 has its outer periphery formed with a central projection 20j and side projections 20k and 20l with the outer peripheral surfaces 20g, 20h intervening therebetween. Outer peripheral surfaces 20m, 20n and 20p of the projections 20j, 20k and 20l extend along the common circumference so that the outer peripheral surfaces 20m, 20n, 20p can be all brought into contact with the opposite inner peripheral surface 5a of the flange 5.

The centrifugal weight member 20 is further formed with diametrically symmetrical communication holes 20q and 20r. The communication holes 20q, 20r open at one ends in the peripheral walls of the spring bores 20c, 20d, respectively, and open at the other ends in a semicircular recess 20s formed in the weight member 20 at its substantially central portion between the planar surfaces 20e and 20f for avoiding interference between the weight member 20 and the center shaft 2 appearing in FIG. 5.

Figure 5:
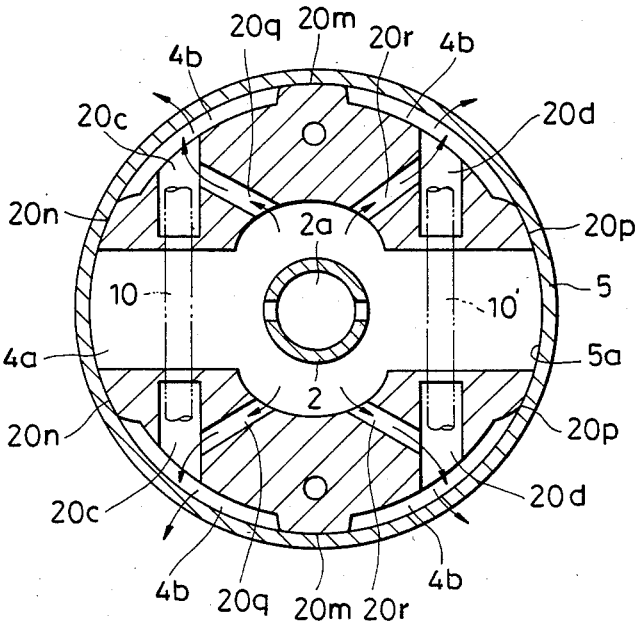
FIG. 5 is a transverse sectional view of a centrifugal injection timing control device according to the invention, in which the centrifugal weight member of FIG. 4 is incorporated.

The centrifugal weight member 20 described above is incorporated into an eccentric type centrifugal injection timing control device in a manner shown in FIG. 5.

First, even when a pair of the centrifugal weight members 20 are in their retracted or non-lifted position, communication is established between the radially inner chamber 4a and the radially outer chambers 4b, defined between the centrifugal weight members 20 and the center shaft 2, and between the centrifugal weight members 20 and the flange 5, respectively, through the communication holes 20q, 20r and the bores 20c, 20d communicating with the holes 20q, 20r. Oil in the chamber 4a accordingly flows into the chambers 4b through the communication holes 20q, 20r and the bores 20c, 20d to fill the interior of the injection timing control device. Therefore, in making adjustment of the injection timing of the injection timing control device, it is not necessary to replace the shim 12 with the shim 12' with a smaller diameter as employed in the conventional arrangement, to realize the same injection timing characteristic as in actual use. On the other hand, as shown in FIG. 5, when the two centrifugal weight members 20, 20 are lifted or radially outwardly displaced due to the centrifugal force produced therein so that the outer peripheral surfaces 20*m*, 20*n*, 20*p* of the projections 20*j*, 20*k*, 20*l* are brought into contact with the inner peripheral surface 5*a* of the flange 5, the chambers 4*a* and 4*b* still communicate with each other through the communication holes 20*q*, 20*r* and the bores 20*c*, 20*d*, as in the retracted position of the weight members 20, 20, permitting the oil in the chamber 4*a* to flow into the chambers 4*b* through the communication holes 20*q*, 20*r* and the bores 20*c*, 20*d* as the centrifugal force acts upon the oil. Thereafter, the oil in the chambers 4*b* flows out of the flange 5 through the clearance between the flange 5 and the shim 12 appearing in FIG. 1.

Therefore, even when the centrifugal weight members 20, 20 return toward the center shaft 2 from their maximum lifted position, negative pressure does not occur in the chambers 4*b*, thereby avoiding the occurrence of a hysteresis in the action of the centrifugal weight members 20, 20 between the lifting strike and the returning or retracting stroke.

Figure 6:
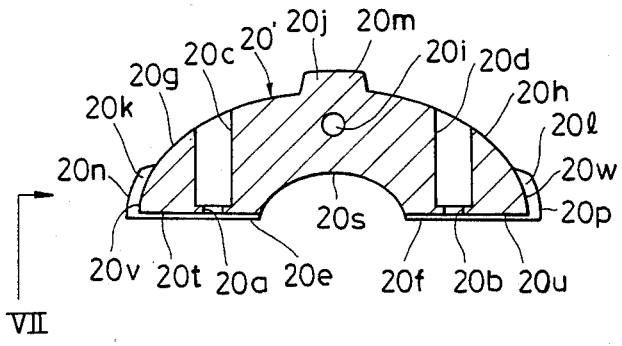
FIG. 6 is a transverse sectional view of a centrifugal weight member according to another embodiment of the invention.
Figure 7:
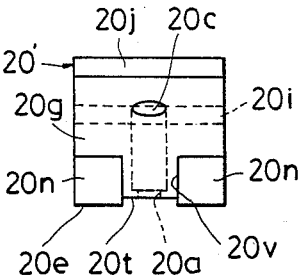
FIG. 7 is an end view of the centrifugal weight member, as viewed from the arrow VII in FIG. 6.

FIGS. 6 and 7 show another embodiment of the invention. In the figures, parts corresponding to those appearing in FIG. 4 showing the above described embodiment of the centrifugal weight member 20 bear the same numerals as in FIG. 4, and detailed explanation thereof is omitted.

In FIGS. 6 and 7, the planar surfaces 20*e*, 20*f* of the centrifugal weight member 20' are each formed with a groove 20*t*, 20*u* radially extending from the recess 20*s* to the side portion 20*k*, 20*l*, while the side portions 20*k*, 20*l* are each formed with a groove 20*v*, 20*w* extending along the outer peripheral surface 20*g*, 20*h* and continuous with the groove 20*t*, 20*u* at one end.

With the arrangement described above, irrespective of whether the centrifugal weight members 20' are in their lifted position or in non-lifted position, oil in the chamber 4*a* can flow through the grooves 20*t*, 20*u*, 20*v*, 20*u* into the chambers 4*b*, or in the direction reverse to the above, i.e. from the chambers 4*b* to the chamber 4*a*, as the centrifugal weight members 20' are displaced, achieving the same function and effect as those described with respect to the first embodiment shown in FIG. 4.

While preferred embodiments of the invention have been described, obviously modifications and variations are possible without departing from the scope and spirit of the present technical concept, which are delineated by the appended claims.

What is claimed is:

1. In a centrifugal injection timing control device for a fuel injection pump, including a driving rotary member, a driven rotary member, a housing arranged concentrically with said driven rotary member and rotatable in unison therewith, centrifugal weight means accommodated within said housing and displaceable diametrically thereof in response to rotation of said driven rotary member, said centrifugal weight means defining a radially inner chamber in cooperation with said driven rotary member and at least one radially outer chamber in cooperation with said housing, and double eccentric cam means interposed between said driving rotary member and said centrifugal weight means and engaging with said driving rotary member and said centrifugal weight means, wherein diametrical displacement of said centrifugal weight means causes corresponding circumferential displacement of said driven rotary member relative to said driving rotary member through said double eccentric cam means;

the improvement comprising:

passage means formed in said centrifugal weight means and communicating said radially inner chamber with said radially outer chamber;

said centrifugal weight means includes a pair of centrifugal weight members arranged diametrically oppositely with respect to said driven rotary member, said centrifugal weight member each having a radially inner face disposed opposite said driven rotary member and defining said radially inner chamber, and a radially outer face disposed opposite said housing and defining said radially outer chamber; and said passage means including a first groove formed in said radially inner face of each of said centrifugal weight members, and a second groove formed in said radially outer face of each of said centrifugal weight members and continuous with said first groove.

2. The centrifugal injection timing control device of claim 1, wherein said radially outer face of each of said centrifugal weight members has a plurality of projections thereon, said projections being circumferentially spaced from each other.

3. In a centrifugal injection timing control device for a fuel injection pump, including a driving rotary member, a driven rotary member, a housing arranged concentrically with said driven rotary member and rotatable in unison therewith, centrifugal weight means accommodated within said housing and displaceable diametrically thereof in response to rotation of said driven rotary member, said centrifugal weight means defining a radially inner chamber in cooperation with said driven rotary member and at least one radially outer chamber in cooperation with said housing, and double eccentric cam means interposed between said driving rotary member and said centrifugal weight means and engaging with said driving rotary member and said centrifugal weight means, wherein diametrical displacement of said centrifugal weight means causes corresponding circumferential displacement of said driven rotary member relative to said driving rotary member through said double eccentric cam means;

the improvement comprising:

passage means formed in said centrifugal weight means and communicating said radially inner chamber with said radially outer chamber;

said centrifugal weight means includes a pair of centrifugal weight members arranged diametrically oppositely with respect to said driven rotary member, said centrifugal weight members each having a radially inner face disposed opposite said driven rotary member and defining said radially inner chamber, and a radially outer face disposed opposite said housing and defining said radially outer chamber; and said radially outer face of each of said centrifugal weight members has a plurality of projections thereon, said projections being circumferentially spaced from each other.

* * * * *